US006907110B2

(12) United States Patent
Apel et al.

(10) Patent No.: US 6,907,110 B2
(45) Date of Patent: Jun. 14, 2005

(54) X-RAY TUBE WITH RING ANODE, AND SYSTEM EMPLOYING SAME

(75) Inventors: Manfred Apel, Rudolstadt (DE); Holger Baule, Oberweissbach (DE); Frank Neumann, Hoechstadt (DE)

(73) Assignee: Siemens Aktiengesellschaft, Münich (DE)

( * ) Notice: Subject to any disclaimer, the term of this patent is extended or adjusted under 35 U.S.C. 154(b) by 0 days.

(21) Appl. No.: 10/654,173

(22) Filed: Sep. 3, 2003

(65) Prior Publication Data

US 2004/0109539 A1 Jun. 10, 2004

(30) Foreign Application Priority Data

Sep. 3, 2002 (DE) ..... 102 40 628

(51) Int. Cl.[7] ..... H01J 35/08
(52) U.S. Cl. ..... 378/143; 378/10; 378/137
(58) Field of Search ..... 378/10, 137, 143, 378/141

(56) References Cited

U.S. PATENT DOCUMENTS 4,250,425 A * 2/1981 Gabbay et al. ..... 378/125
4,352,986 A * 10/1982 Pfeiler ..... 378/14
4,926,452 A * 5/1990 Baker et al. ..... 378/22
4,962,513 A 10/1990 Schwierz et al. ..... 378/12
5,305,363 A * 4/1994 Burke et al. ..... 378/4
5,751,784 A 5/1998 Enck ..... 378/140
6,292,538 B1 9/2001 Hell et al. ..... 378/137
6,339,635 B1 * 1/2002 Schardt et al. ..... 378/137
6,381,487 B1 4/2002 Flohr et al. ..... 600/425

FOREIGN PATENT DOCUMENTS

JP 3-53436 7/1989

* cited by examiner

*Primary Examiner*—Craig E. Church
*Assistant Examiner*—Jurie Yun
(74) *Attorney, Agent, or Firm*—Schiff Hardin LLP

(57) ABSTRACT

An x-ray tube has a stationary vacuum housing, in which are arranged an electron-emitting cathode and a ring anode with an impact surface on which the electron beam, accelerated by an electrical field, is incident, as well as a deflection system to focus and deflect the electron beam. The ray exit window of the x-ray tube is round, lies in the plane perpendicular to the central axis of the x-ray tube, and terminates one side at the vacuum housing. The impact surface of the ring anode is beveled and is aligned to the ray exit window. A diaphragm is provided in front of the ray exit window that defines a circular opening for the x-ray radiation. The ring anode is surrounded by an annular anode cooling arrangement.

15 Claims, 7 Drawing Sheets

X-RAY TUBE WITH RING ANODE, AND SYSTEM EMPLOYING SAME

BACKGROUND OF THE INVENTION

1. Field of the Invention

The present invention concerns an x-ray tube of the type having a fixed vacuum housing, in which are arranged an electron-emitting cathode and a ring anode with an impact surface that is struck by the electron beam that is accelerated by an electrical field, as well as with a deflection system to focus and deflect the electron beam. Such x-ray tubes are generally known and serve for the generation of x-ray radiation for examinations of subjects.

2. Description of the Prior Art

Generally, x-ray tubes are used with a fixed anode. In medical technology, for higher outputs the focal spot of the x-ray tube is generated on a focal spot path by rotating the anode by means of an electromagnetic drive, such that the heat load is spread over a large surface. Heat storage ensues by means of a graphite plate. Such x-ray tubes require a complicated positioning of the anode due to the necessary high rotation frequency and (in particular due to the graphite plate) the high weight. Cooling of the anode normally ensues indirectly. Direct cooling is very complicated.

X-ray tubes called rotary piston tubes are known from U.S. Pat. No. 6,292,538, in which the entire housing of the x-ray tube with the anode is rotated while the electron beam is deflected by a deflection system in a direction onto the focal spot path of the anode, such that the x-ray radiation laterally emerges from the x-ray tube at a fixed location. This patent also discloses laterally, discretely, azimuthally deflecting the focal spot on the focal spot path, such that it appears at two positions of the anode. This serves in computed tomography, for example, to increase the resolution, whereby the focus oscillates with high frequency around a half pixel pitch of the detector line (spring focus). In each case the x-ray tube is mechanically rotated in addition to the anode. Also, the rotary piston tube requires a complex positioning of the tube as well as an electromagnetic drive.

Electron beam tomography is known from U.S. Pat. No. 4,962,513, in which the x-ray radiation is generated by a continuously deflected electron beam that is incident on a circular anode arch. The x-ray radiation permeates the measurement field and arrives at a suitably fashioned detector arc. Such an electron beam tomograph requires namely no mechanically moved parts and can be directly cooled, however it has a complicated, large, and expensive assembly, such that it is used only in small numbers.

An x-ray tube is specified in Japanese Application 3 053 436 that is comprised of an electron source, deflection coil, and two electrodes arranged coaxially. An electron beam generated from an electron source is deflected by a deflection coil such that it impacts in the center between the coaxially arranged inner electrode and the outer electrode, and moves circularly on a focal spot path on the inner wall of the outer electrode. A potential difference exists between the electrodes, one underneath the other.

SUMMARY OF THE INVENTION

An object of the present invention is to provide an x-ray tube of the type initially described that exhibits a small, compact structural shape, can be used universally, and can be produced economically.

The object is achieved in accordance with the invention in an x-ray tube of the type initially described wherein the ray exit window of the x-ray tube is round, lies in the plane perpendicular to the central axis of the x-ray tube, and terminates one side of the vacuum housing, and wherein the impact surface of the ring anode is beveled and aligned to the ray exit window, and wherein the ring anode is surrounded by an annular anode cooling arrangement. The x-ray tube has the same advantages as the electron beam tomography system; it has no mechanical parts in the radiator, and thus accrues no mechanical wear. No drive energy is required. Neither noises nor vibrations occur. It is immediately ready for use, since it has no run-up time. Components can be saved such as, for example, for actuation or coupling. The cooling surface of the stationary anode can be greatly enlarged in order to enable an optimal cooling of the anode, such that a targeted coolant flow and a better heat spreading ensue. It also enables a high angular frequency of 150 KHz of the electron beam to the anode, instead of 150 Hz as in a rotating tube. Also, a simple supply of the high voltage ensues since no transformer or sliding contact is necessary. The inventive x-ray tube is only as large as a normal x-ray tube, but is considerably simpler, more manageable, and less expensive.

In contrast to the x-ray tube described in Japanese Application 3 053 436, the inventive x-ray tube has an anode ring instead of the 2 coaxially arranged electrodes. A potential difference to operate the x-ray tube and an isolated assembly between the electrodes are not necessary. Due to the simple assembly of the inventive x-ray tube, the arrangement of the emitter, anode ring, and deflection system is variable.

It has proven to be advantageous for the vacuum housing to have an isolator, an expanding piston part, a ring anode, and an x-ray permeable ray exit window covering the ring anode.

The deflection system can be a quadrupole magnet system.

Variation of the direction of the generated x-ray radiation can be accomplished on an embodiment wherein the impact surface of the ring anode is fashioned with a cross-section that is primarily arc shaped, with the center point of the circular impact surface being outside of the ring anode.

Alternatively, the ring anode can exhibit a primarily triangular cross section with a long and a short side, the short side being directed at the ray exit window and carrying the impact surface.

The cross-section of the ring anode also can be symmetrically fashioned. An arrangement of ray exit windows on both sides of the anode ring enables a two-sided emergence of the x-ray radiation depending on the deflection of the electron beam. The emitter is preferably centrally arranged in the ring anode plane.

In a further variation of the arrangement of emitter, anode ring, and deflection system, the emitter is located with the deflection system on the side of the ray exit window.

The x-ray tube can be used in an x-ray system, for example for computed tomography, when a slit diaphragm is arranged in the path of the beam between the x-ray tube and a detector matrix.

A number of discretely arranged beam fans can be generated by arranging a depth diaphragm between the x-ray tube and the detector matrix. The depth diaphragm is aligned such that it accepts a number of successive beam fans along the impact surface that, by deflection of the electron beam, strike respective detector lines of the detector matrix.

DESCRIPTION OF THE PREFERRED EMBODIMENTS

Figure 1:
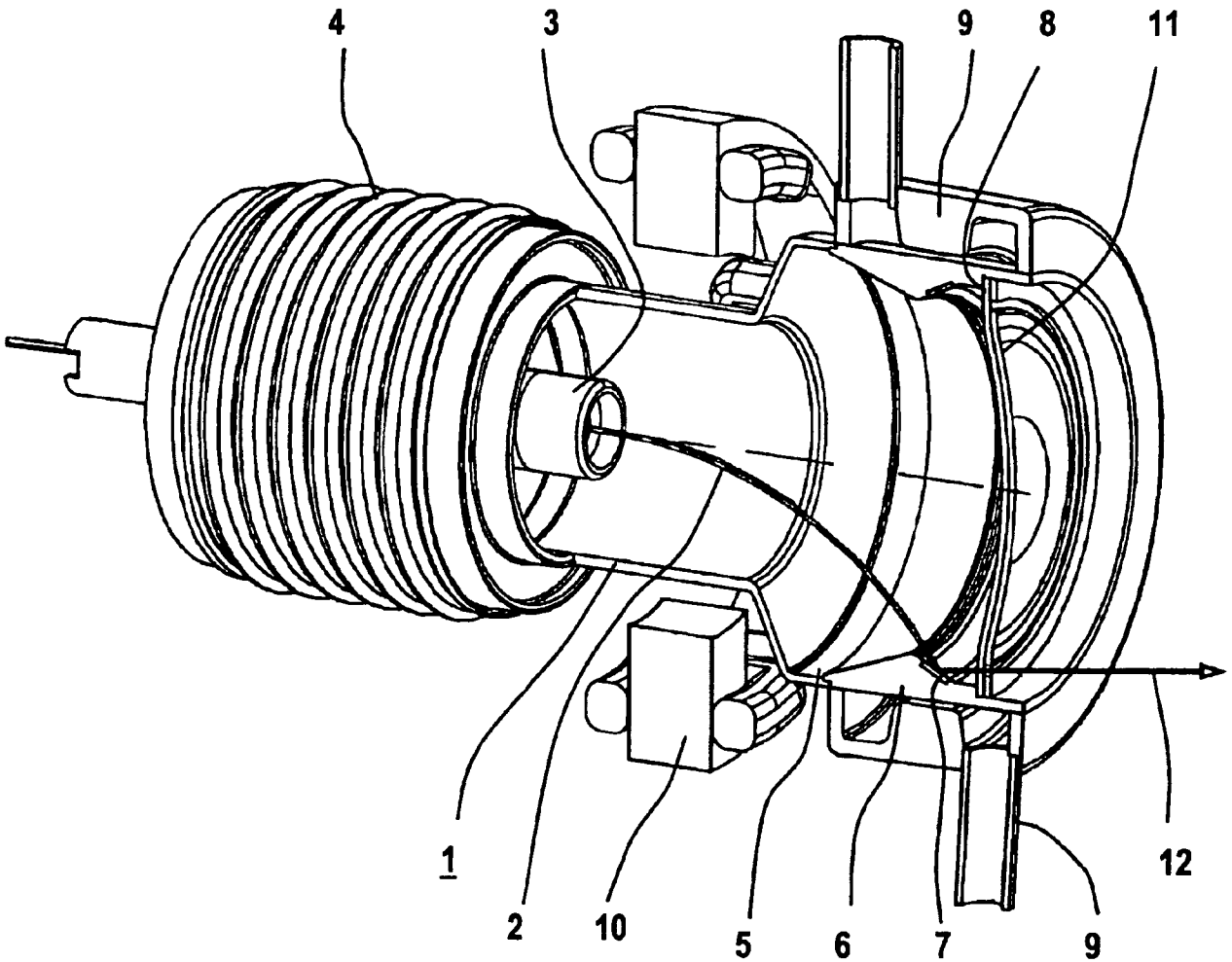
FIG. 1 illustrates an inventive x-ray tube, shown partially cut, away.

The inventive x-ray tube is shown in the FIG. 1 with a vacuum housing 1 in which a cathode 3 with a round emitter is located as a generator of an electron beam 2.

The cathode 3 is mechanically connected to a ring anode 6 via an isolator 4 and an expanding piston part 5. The surface of the ring anode 6 facing inwards exhibits a primarily triangular cross-section with a long side and a short side. The long side is aligned toward the cathode 3. An impact surface 7 for the electron beam 2 is disposed on the short side.

An x-ray transparent ray exit window 8 is arranged in front of the ring anode 6 and forms the front termination of the x-ray tube. A anode cooling 9 is arranged around the ring anode 6 that has an inlet and an outlet as well as channels for the coolant and particularly in the region of the impact surface 7, is thermoconductively connected with the ring anode 6. In the region of the emitter of the cathode 3, a deflection system 10 is arranged around the piston part 5 of the vacuum housing 1 of the x-ray tube that, for example, can be a quadrupole magnet system with an annular carrier, four pole projections, and coils surrounding them, as is specified in U.S. Pat. Nos. 6,339,635 and 6,292,538, for example.

A diaphragm ring filter 11 can be arranged on the ray exit window 8 that prevents the escape of x-ray radiation and permits x-ray radiation to pass only in a circular region, thereby reducing extra-focal radiation.

By applying a negative high voltage to the cathode 3, electrons emerge from the incandescent emitter that are focused by the deflection system 10 to form the electron beam 2 that is deflected so as to strike the side (i.e., the impact surface 7) facing the ray exit window 8 of the triangularly fashioned surface of the ring anode 6, which is at ground potential. X-ray radiation is generated as a result, that is blanked by the diaphragm ring filter 11 such that strongly focused x-ray radiation (that is schematically shown as reference beam 12) exits the x-ray tube.

Besides the deflection of the electron beam 2 onto the ring anode 6, the deflection system 10 effects a deflection of the electron beam 2 onto the impact surface 7 in direction tangential to the ring anode 6, such that the curved electron beam 2 is turned around the central axis of the x-ray tube. This can ensue continuously, such that the x-ray radiation moves along a circle, however, the electron beam 2 also can be targeted on discrete positions, such that the x-ray radiation is successively generated in various foci.

Figure 2:
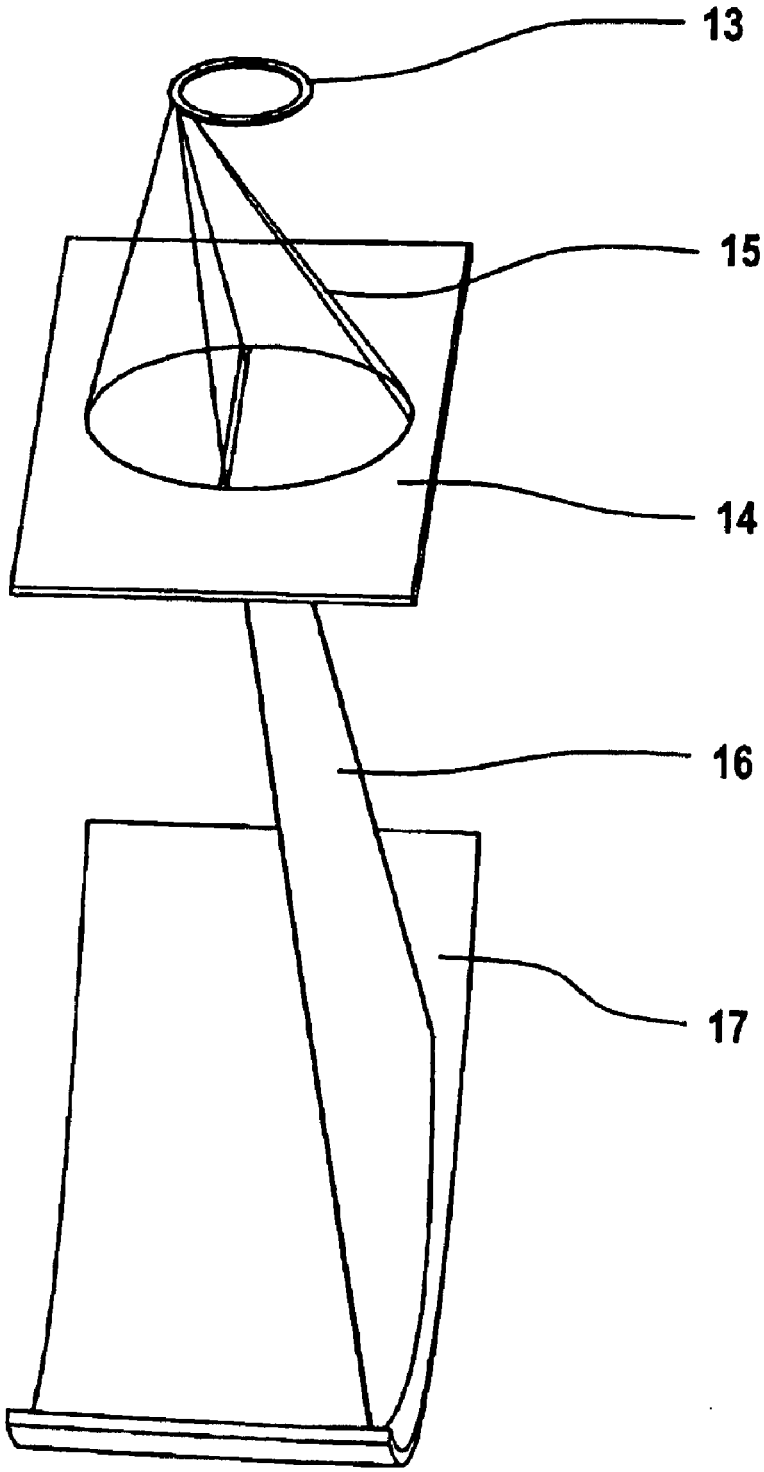
FIG. 2 illustrates a first embodiment for an single-line scan of a detector matrix with a moving beam fan in a computed tomography system.

In FIG. 2, an arrangement to use the inventive x-ray tube in a computed tomography system with an arced detector matrix 17 is shown. The x-ray tube (of which only a focal spot path 13 is schematically shown) is arranged in front of a slit diaphragm 14, such that a beam fan 16 is fashioned from the ray beam 15 is emitted from the x-ray tube. The beam fan 16 permeates the measurement field and strikes the a detector matrix 17. A ray beam 15 is generated from different directions due to the movement of an electron beam 2 on the focal spot path 13, such that as a consequence of the slit diaphragm 14 the beam fan 16 sweeps over the surface of the detector matrix 17. A number of different layer exposures thus can be generated in the shortest time possible in one position of the x-ray tube without mechanical movement.

Figure 3:
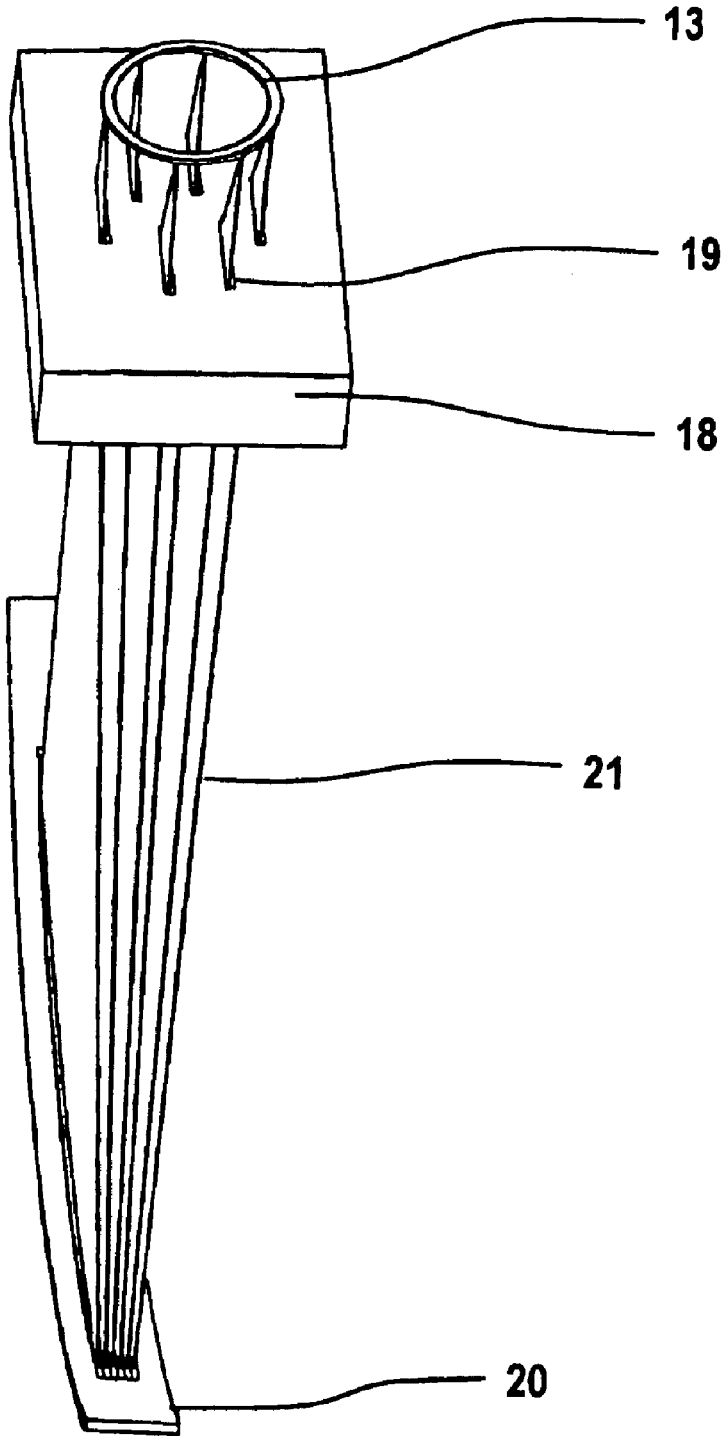
FIG. 3 shows a further CT arrangement to generate a number of beam fans via a multi-slit depth diaphragm.

A depth diaphragm 18 is arranged in front of the x-ray tube in FIG. 3 that has a number of slits 19 that are directed at detector lines of the detector 20 of a computed tomography system. The slits 19 are arranged such that the beam fans 21 emerging from them respectively are emitted at another point on the focal spot path 13. The center lines of the slits 19 preferably exhibit the same separations from one another. The points of origin on the focal spot path 13 are also uniformly spread out in an advantageous manner. Each slit 19 of the depth diaphragm 18 generates a beam fan 21 that strikes a detector line associated with that beam fan.

Figure 4:
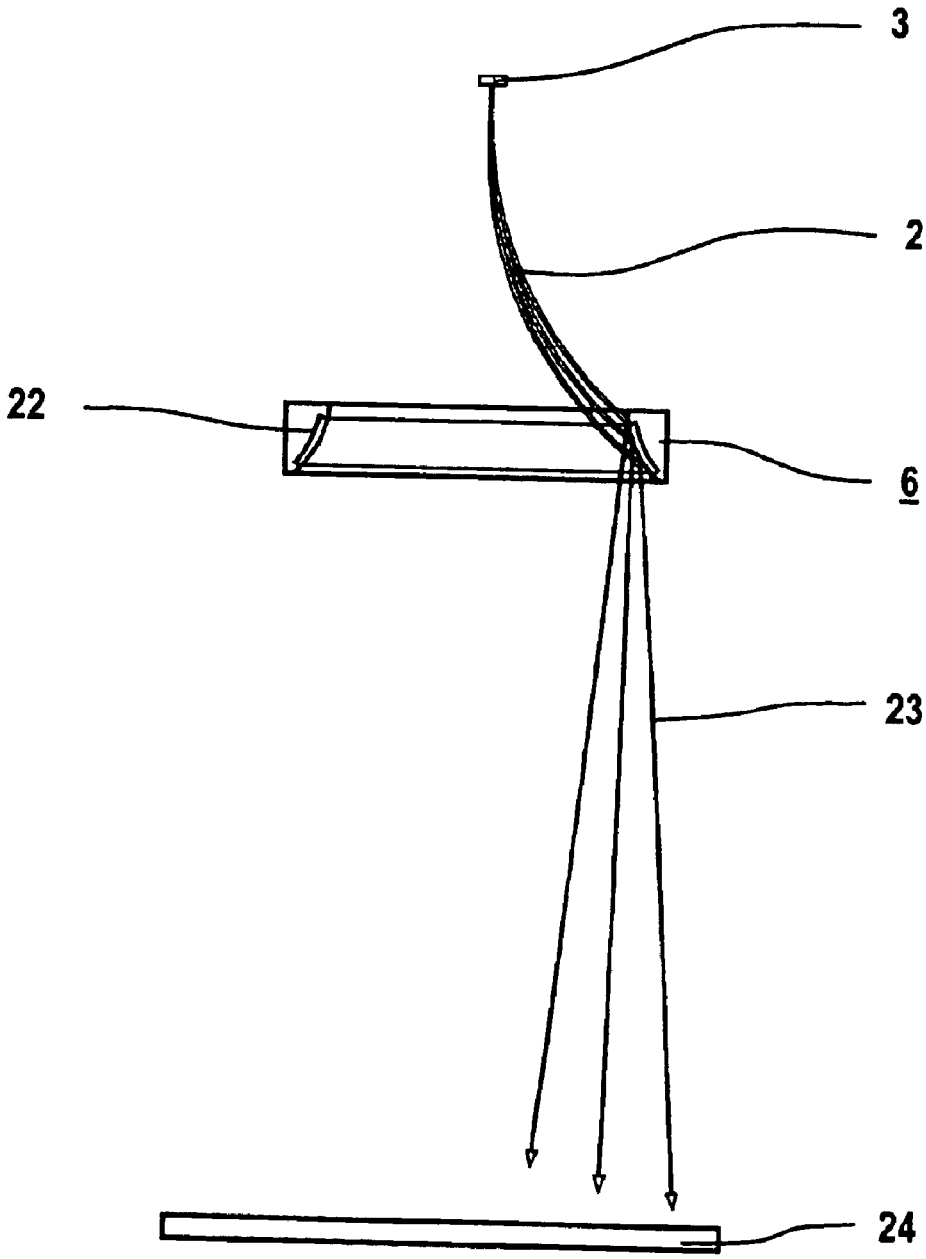
FIG. 4 shows an arrangement for use of the inventive x-ray tube in tomoscopy.

A further embodiment for application in the field of tomosynthesis is schematically shown in FIG. 4. Proceeding from the cathode 4, the electron beam 2 strikes the ring anode 6, the impact surface 22 of which is curved inwardly toward the center of the ring anode 6, surface that is directed at the ray exit window 8. By means of different curvatures of the electron beam 2, the entire surface of the focal spot path of the ring anode 6 can be covered, such that x-ray radiation 23 with different orientations can be generated, as is indicated in FIG. 4 by the reference beams 23. The x-rays strike a surface detector 24 that can be an x-ray film, an x-ray image intensifier, or a matrix detector, for example an aSi detector. Due to this arrangement, the x-rays can thus be deflected such that they emerge from a number of focal points, so that they can be used in typical tomoscopy or tomosynthesis, in which conventionally a number of radiation sources are activated in succession. In tomosynthesis, a set of x-ray images is acquired from different directions and algorithmically calculated by computer with special filter methods into volume layer images.

Figure 5:
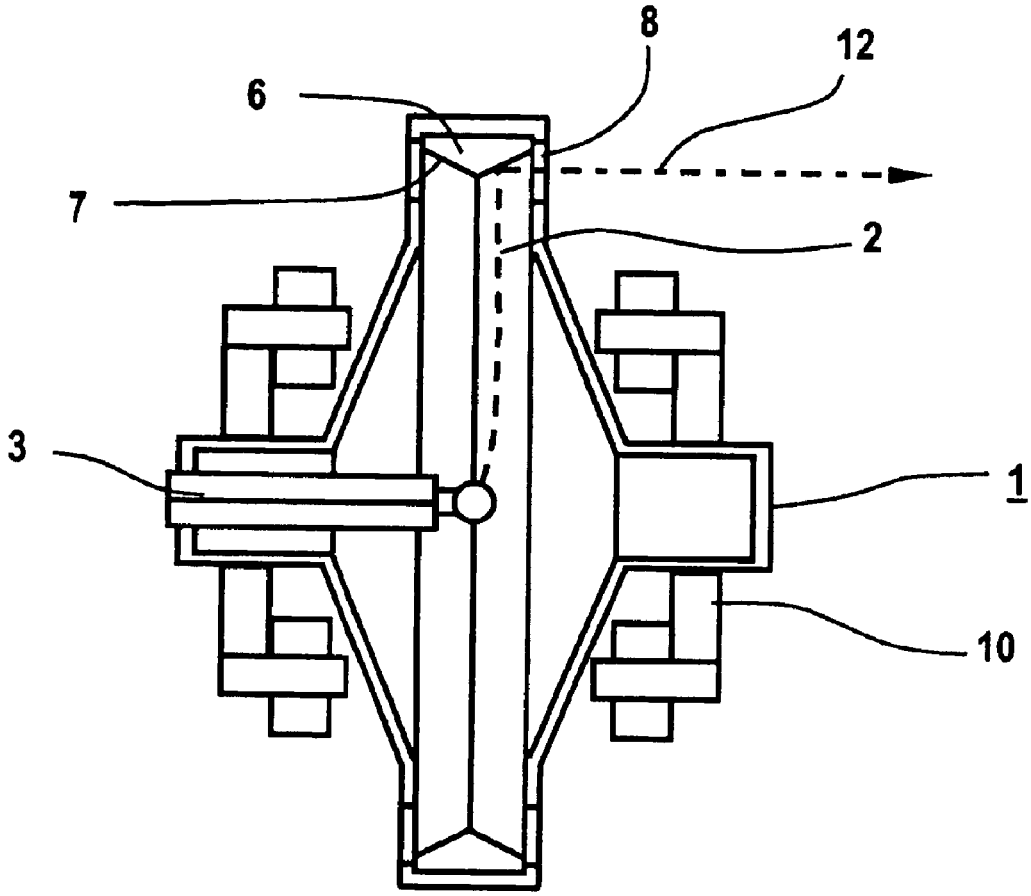
FIG. 5 shows an arrangement of the emitter in the ring anode plane.

A rotating beam tube with a centric emitter arrangement is shown in FIG. 5 that has a ring anode with two symmetrically arranged beveled or curved impact surfaces 7 and two ray exit windows 8. The emitter of the cathode 3 is located centrally in the plane of the ring anode 6. Depending on the deflection of the electron beam 2 by one or more deflection systems 10, the focal spot is generated on one of the two impact surfaces 7 of the ring anode, and the x-ray radiation emerges from the ray exit window 8 facing the impact surface 7. The impact surfaces 7 can be formed by different anode materials, so that x-ray radiation of different qualities is generated depending on the deflection of the electron beam 2.

Figure 6:
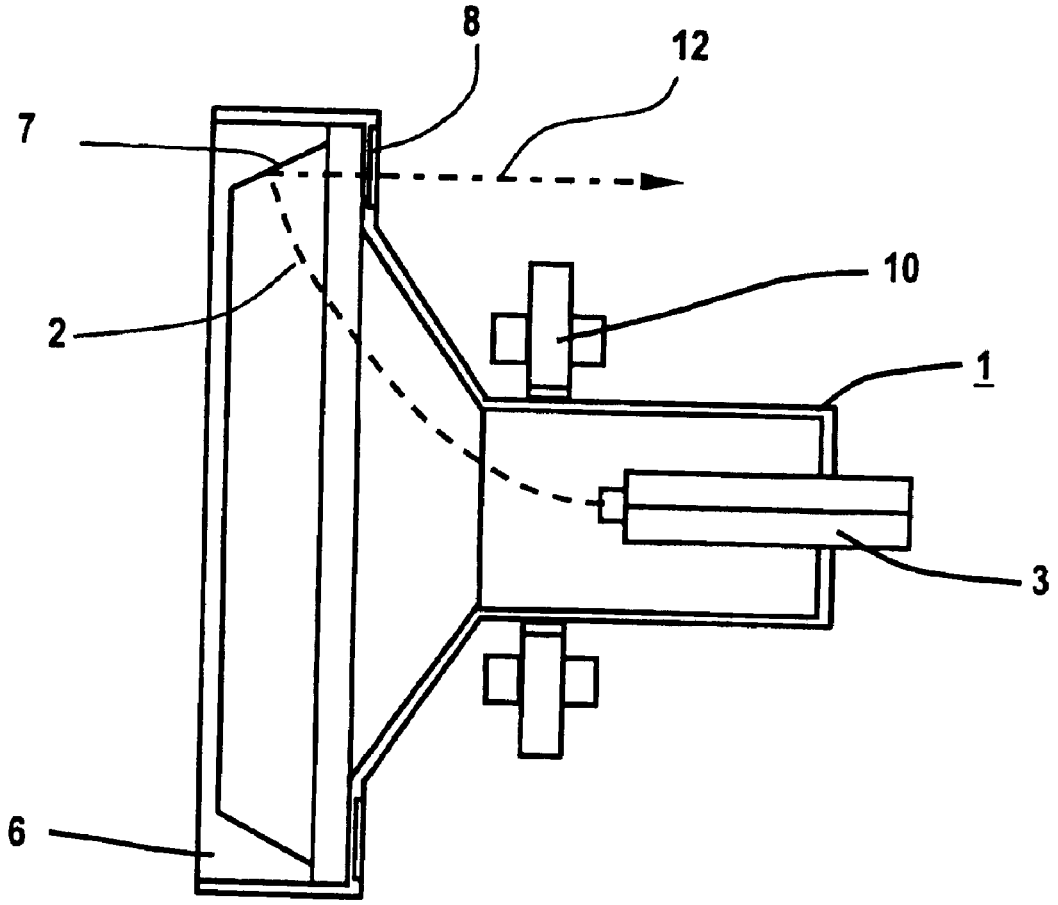
FIG. 6 shows a rotating beam tube with a window-proximate emitter arrangement.

FIG. 6 shows a rotating beam tube with window-proximate emitter arrangement, in which the x-ray radiation is emitted via the ray exit window 8 by arrangement of the impact surface 7 of the ring anode 6 in the opposite direction from the electron beam exit location.

Figure 7:
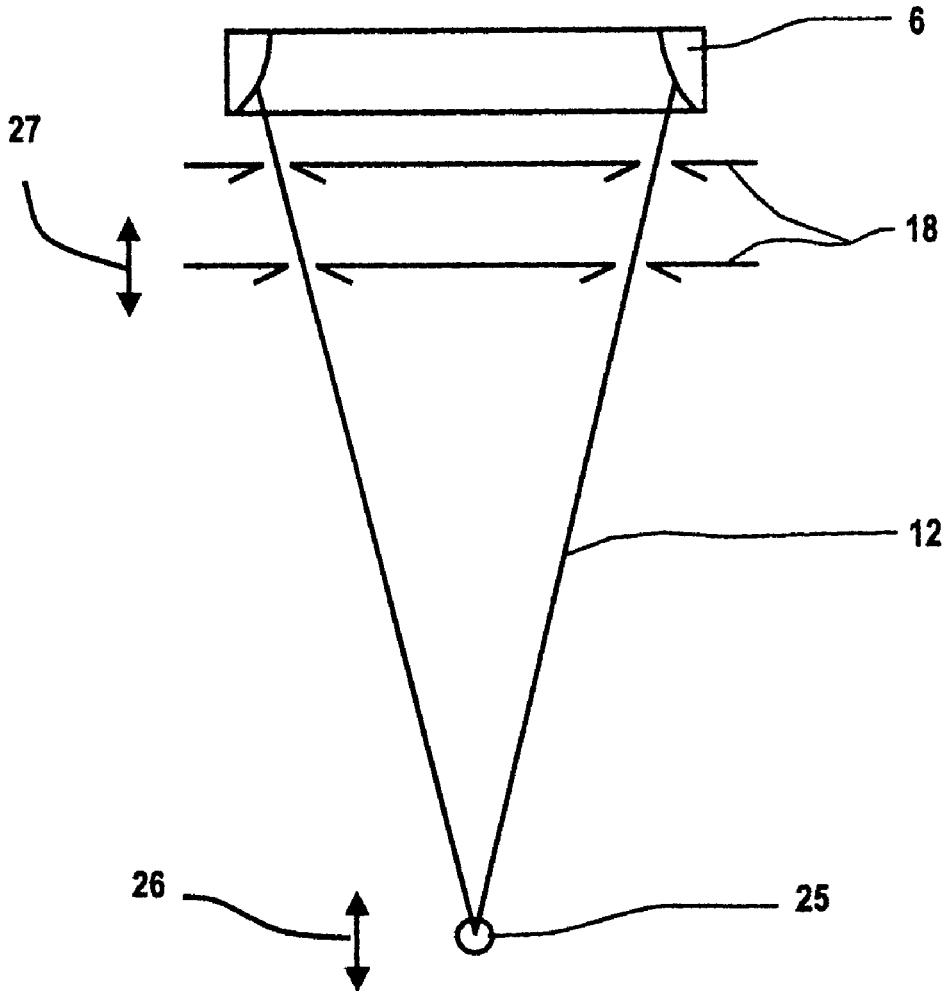
FIG. 7 shows an arrangement to use the inventive x-ray tube in radiation therapy.

An arrangement for use of the x-ray tube in radiation therapy is schematically shown in FIG. 7. The electron beam 2 rotating continuously around the tube axis generates a revolving focal spot on the ring anode 6. X-ray radiation is thereby generated that is gated by a depth diaphragm 25 and emerges as a beam cone in front of the x-ray tube such that it is focused at a point. This beam focus 27 can be directed to target for irradiation of tumor tissue. By varying the depth diaphragm 15 as to its distance from the rotating focal spot in the direction of the double arrow 27, the height of the beam focus 25 can be set targeted in the direction of the double arrow 28.

Due to the high efficiency of the rotating beam tube with good heat spreading due to high rotation speed of the focal spot and good heat dissipation due to direct cooling, the radiation intensity in the beam focus 26 is very high. The dimension of the beam focus 27 can be variably adjusted via the quadrupole arrangement. Due to the focal spot control, exposures also can be made with the x-ray tube, such that the therapy device can be used simultaneously for a diagnosis.

Although modifications and changes may be suggested by those skilled in the art, it is the intention of the inventors to embody within the patent warranted hereon all changes and modifications as reasonably and properly come within the scope of their contribution to the art.

We claim:

1. An x-ray tube comprising:

a stationary vacuum housing having a central axis;

an electron-emitting cathode and a ring anode having an impact surface disposed in said vacuum housing;

a deflection system disposed in said vacuum housing for interacting with electrons emitted by said cathode to focus and deflect said electrons to form an electron beam which is incident on said impact surface to generate x-rays;

a round exit window for said x-rays disposed in a plane perpendicular to the central axis and terminating one side of said vacuum housing;

said ring anode having a primarily triangular cross-section in a plane containing said electron beam, with a long side and a short side, said short side being directed toward said exit window and said impact surface being disposed on said short side, and said impact surface of said ring anode being beveled and aligned to said exit window; and an annular anode cooling arrangement surrounding said ring anode at an exterior of said vacuum housing.

2. An x-ray tube as claimed in claim 1 further comprising a diaphragm disposed at said exit window at said vacuum housing defining a circular opening for passage of said x-rays therethrough.

3. An x-ray tube as claimed in claim 1 wherein said vacuum housing comprises an isolator at least partially surrounding said cathode and a piston part, connected to said isolator, said piston part having an expanded portion in which said ring anode is disposed and having said side terminated by said exit window.

4. An x-ray tube as claimed in claim 1 wherein said deflection system is a quadruple magnet system.

5. An x-ray system comprising:

an x-ray tube comprising a stationary vacuum housing having a central axis, an electron-emitting cathode and a ring anode having an impact surface disposed in said vacuum housing, a deflection system disposed in said vacuum housing for interacting with electrons emitted by said cathode to focus and deflect said electrons to form an electron beam which is incident on said impact surface to generate x-rays, a round exit window for said x-rays disposed in a plane perpendicular to the central axis and terminating one side of said vacuum housing, said impact surface of said ring anode being beveled and aligned to said ring anode having a primarily triangular cross-section in a plane containing said electron beam, with a long side and a short side, said short side being directed toward said exit window and said impact surface being disposed on said short side, and said impact surface of said ring anode being beveled and aligned to said exit window, and an annular anode cooling arrangement surrounding said ring anode at an exterior of said vacuum housing;

a radiation detector, said x-ray tube being oriented relative to said radiation detector so that said x-rays exiting through said exit window are incident on said radiation detector; and a slit diaphragm disposed in a path of said x-rays between said x-ray tube and said radiation detector.

6. An x-ray system comprising:

an x-ray tube comprising a stationary vacuum housing having a central axis, an electron-emitting cathode and a ring anode having an impact surface disposed in said vacuum housing, a deflection system disposed in said vacuum housing for interacting with electrons emitted by said cathode to focus and deflect said electrons to form an electron beam which is incident on said impact surface to generate x-rays, a round exit window for said x-rays disposed in a plane perpendicular to the central axis and terminating one side of said vacuum housing, said ring anode having a primarily triangular cross-section in a plane containing said electron beam, with a long side and a short side, said short side being directed toward said exit window and said impact surface being disposed on said short side, and said impact surface of said ring anode being beveled and aligned to said exit window, and an annular anode cooling arrangement surrounding said ring anode at an exterior of said vacuum housing;

a radiation detector, said x-ray tube being oriented relative to said radiation detector so that x-rays exiting through said exit window are incident on said radiation detector; and a depth diaphragm disposed in a path of said x-rays between said x-ray tube and said radiation detector, said depth diaphragm having a plurality of slits, and wherein said deflection system in said x-ray tube deflects said electron beam relative to said impact surface to produce a plurality of beam fans, said depth diaphragm having a plurality of slits through which said beam fans respectively pass, and strike respective detector lines of said radiation detector.

7. An x-ray tube comprising:

a stationary vacuum housing having a central axis;

an electron-emitting cathode and a ring anode having an impact surface disposed in said vacuum housing;

a deflection system disposed in said vacuum housing for interacting with electrons emitted by said cathode to focus and deflect said electrons to form an electron beam which is incident on said impact surface to generate x-rays;

a round exit window for said x-rays disposed in a plane perpendicular to the central axis and terminating one side of said vacuum housing;

said impact surface of said ring anode having a cross-section in a plane containing said electron beam primarily formed as a circular arc, and said impact surface of said ring anode being beveled and aligned to said exit window; and an annular anode cooling arrangement surrounding said ring anode at an exterior of said vacuum housing.

8. An x-ray tube as claimed in claim 7 wherein said impact surface has a center point disposed outside of said ring anode.

9. An x-ray tube as claimed in claim 7 further comprising a diaphragm disposed at said exit window at said vacuum housing defining a circular opening for passage of said x-rays therethrough.

10. An x-ray tube as claimed in claim 7 wherein said vacuum housing comprises an isolator at least partially surrounding said cathode and a piston part connected to said isolator, said piston part having an expanded portion in which said ring anode is disposed and having said side terminated by said exit window.

11. An x-ray tube as claimed in claim 7 wherein said deflection system is a quadruple magnet system.

12. An x-ray system comprising:

an x-ray tube comprising a stationary vacuum housing having a central axis, an electron-emitting cathode and a ring anode having an impact surface disposed in said vacuum housing, a deflection system disposed in said vacuum housing for interacting with electrons emitted by said cathode to focus and deflect said electrons to form an electron beam which is incident on said impact surface to generate x-rays, a round exit window for said x-rays disposed in a plane perpendicular to the central axis and terminating one side of said vacuum housing, said impact surface of said ring anode having a cross-section in a plane containing said electron beam primarily formed as a circular arc, and said impact surface of said ring anode being beveled and aligned to said exit window, and an annular anode cooling arrangement surrounding said ring anode at an exterior of said vacuum housing;

a radiation detector said x-ray tube being oriented relative to said radiation detector so that said x-rays exiting through said exit window are incident on said radiation detector; and a slit diaphragm disposed in a path of said x-rays between said x-ray tube and said radiation detector.

13. An x-ray tube as claimed in claim 12 wherein said impact surface has a center point disposed outside of said ring anode.

14. An x-ray system comprising:

an x-ray tube comprising a stationary vacuum housing having a central axis, an electron-emitting cathode and a ring anode having an impact surface disposed in said vacuum housing, a deflection system disposed in said vacuum housing for interacting with electrons emitted by said cathode to focus and deflect said electrons to form an electron beam which is incident on said impact surface to generate x-rays, a round exit window for said x-rays disposed in a plane perpendicular to the central axis and terminating one side of said vacuum housing, said impact surface of said ring anode having a cross-section in a plane containing said electron beam primarily formed as a circular arc, and said impact surface of said ring anode being beveled and aligned to said exit window, and an annular anode cooling arrangement surrounding said ring anode at an exterior of said vacuum housing;

a radiation detector, said x-ray tube being oriented relative to said radiation detector so that x-rays exiting through said exit window are incident on said radiation detector; and a depth diaphragm disposed in a path of said x-rays between said x-ray tube and said radiation detector matrix, said depth diaphragm having a plurality of slits, and wherein said deflection system in said x-ray tube deflects said electron beam relative to said impact surface to produce a plurality of beam fans, said depth diaphragm having a plurality of slits through which said beam fans respectively pass, and strike respective detector lines of said radiation detector.

15. An x-ray tube as claimed in claim 14 wherein said impact surface has a center point disposed outside of said ring anode.

* * * * *